US010625986B1

(12) United States Patent
Knouse

(10) Patent No.: US 10,625,986 B1
(45) Date of Patent: Apr. 21, 2020

(54) LIFTING ASSEMBLY

(71) Applicant: Sherry A. Knouse, San Antonio, TX (US)

(72) Inventor: Sherry A. Knouse, San Antonio, TX (US)

( * ) Notice: Subject to any disclaimer, the term of this patent is extended or adjusted under 35 U.S.C. 154(b) by 0 days.

(21) Appl. No.: 16/033,591

(22) Filed: Jul. 12, 2018

(51) Int. Cl.

| | |
|---|---|
| ***B66C 1/12*** | (2006.01) |
| ***A61G 3/06*** | (2006.01) |
| ***B66C 1/18*** | (2006.01) |
| ***B66C 1/14*** | (2006.01) |
| *B66C 23/44* | (2006.01) |

(52) U.S. Cl.
CPC ..... *B66C 1/18* (2013.01); *A61G 3/062* (2013.01); *B66C 1/14* (2013.01); *B66C 23/44* (2013.01)

(58) Field of Classification Search
CPC .... B66C 1/12; B66C 1/14; B66C 1/18; B66C 23/44; A61G 3/02; A61G 3/062; A61G 3/0808; B60P 1/548; B60P 1/5433
USPC ..... 294/74–77, 67.4; 5/87.1, 89.1
See application file for complete search history.

(56) References Cited

U.S. PATENT DOCUMENTS 2,668,732 A * 2/1954 Carlson ..... B66C 1/18 294/75
2,687,321 A * 8/1954 Toffolon ..... B66C 1/18 294/74
2,749,957 A * 6/1956 Smith ..... B65D 65/00 294/150
3,870,358 A * 3/1975 Bennett ..... B66C 1/18 294/77
4,127,200 A 11/1978 Mann
5,090,580 A * 2/1992 Nelson ..... B66C 23/44 212/180
5,967,579 A * 10/1999 Hebert ..... B65D 88/1618 222/105
6,059,335 A * 5/2000 Matson ..... B66C 1/12 294/74
7,448,661 B2 * 11/2008 Daigle ..... B66C 1/18 294/74
7,726,710 B2 * 6/2010 Handwerker ..... E04G 21/24 294/215
2016/0176683 A1 * 6/2016 Huehn ..... B66C 1/16 294/74

* cited by examiner

*Primary Examiner* — Dean J Kramer
(74) *Attorney, Agent, or Firm* — Sanchelima & Associates, P.A.; Christian Sanchelima; Jesus Sanchelima

(57) ABSTRACT

The present invention is a lifting assembly to be used with a lift mechanism installed in a vehicle. The lifting assembly includes a supporting structure in the shape of a cross, with a connecting arrangement attached thereto. The connecting arrangement include apertures to which two or more cables may be engaged. The cables may further be engaged at their other ends with a shackle which is adapted to be fixedly attached to the lift mechanism. The lift mechanism, when operated, causes the supporting structure to be suspended in the shape of a sling arrangement, which can be utilized to support various types of items, including a wheelchair. The wheelchair supported in the supporting structure can be hoisted by operating the lift mechanism for storage and other purposes, as desired.

6 Claims, 3 Drawing Sheets

LIFTING ASSEMBLY

BACKGROUND OF THE INVENTION

1. Field of the Invention

The present disclosure generally relates to a lifting assembly, and more particularly to a lifting assembly to be used with a lift mechanism installed in a vehicle, such as a pickup truck, or the like for hoisting, stowing and removing of a wheelchair.

2. Description of the Related Art

Heretofore there have been provided many arrangements for lifting and transporting of wheelchairs with an automobile for providing aid to handicapped persons. For example, some vehicles, like pickup trucks, are fitted with wheelchair lifting mechanisms which lifts and stores the wheelchair in a back thereof. A typical wheelchair lifting mechanism is a power mechanism used to move the lift out from a stored position to an operating position, then to raise and lower the lift, and then to move the lift from the operating position back to the stored position. In some other wheelchair lifting mechanisms, the wheelchair is first attached to the lifting mechanism before start of the travel, and the lifting mechanism is then operated to lift the wheelchair to be stored in the vehicle, and later the lifting mechanism is again operated to remove the wheelchair from the vehicle and place it back on to the ground at the end of the travel and/or when desired by the user.

Applicant believes a related reference corresponds to Granted U.S. Pat. No. 4,127,200 (hereinafter referred to as '200 Patent) which describes an apparatus for hoisting a wheelchair into and out of an enclosure including a swivel base having a stationary section that may be secured within the closure and a section rotatable on the stationary section about a vertical axis. A motor mount is positioned above and is connected to the rotatable section of the swivel base. An angled arm is pivotally connected to the motor mount and is capable of standing rigidly upright when in use and capable of folding down when not in use. A cable, attached to a reel at one end, has a series of pulleys located on the angled arm to guide the cable over the angled arm. The reel is formed to the motor mount and is connected to a motor on the motor mount through use of gearing. A hook is formed at the other end of the cable for use in hoisting.

Typically, these wheelchair lifting mechanisms, such as the one described in the '200 Patent, require some modifications to be performed to the wheelchair in order to allow for proper attachment and engagement of the wheelchair with the lifting mechanism during the said operation. The modifications may be in the form of form of drilling holes and/or fitting mounting means to the wheelchair to allow for hooks or the like of the lifting mechanism to be attached thereto, which is generally not desirable. For instance, in the wheelchair hoisting apparatus of the '200 Patent, a ring or the like may be needed to be installed in an upper part of the wheelchair in order to allow for the hook of the lifting mechanism to engage with the wheelchair. These modifications are generally expensive, cumbersome and potentially damaging to the wheelchair.

Accordingly, there exists a need in the art to provide a lifting assembly which could be utilized with existing wheelchair lift mechanisms to allow for hoisting and placement of the wheelchair without requiring any particular modifications. Other documents describing the closest subject matter provide for a number of more or less complicated features that fail to solve the problem in an efficient and economical way. None of these patents suggest the novel features of the present invention.

SUMMARY OF THE INVENTION

It is one of the main objectives of the present invention to provide a lifting assembly which can be utilized with a traditional lift mechanism.

It is another objective of the present invention to provide a lifting assembly which can be employed for lifting any type of wheelchair without need of any particular modification thereto.

It is yet another objective of the present invention to provide a lifting assembly for a wheelchair which is simple in design, portable and easy to handle.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

Figure 1:
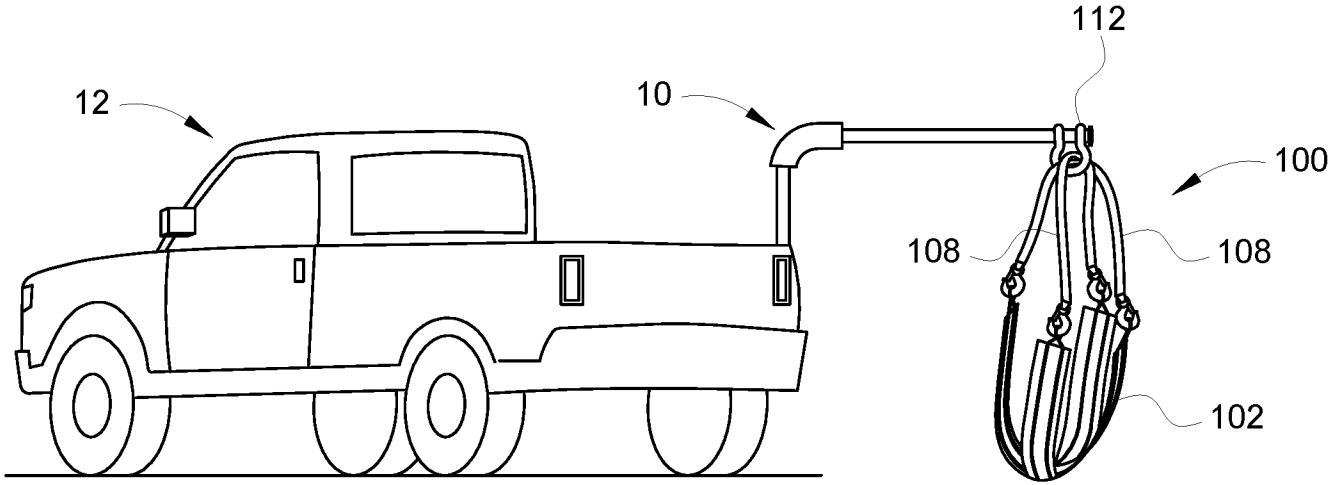
FIG. 1 illustrates a diagrammatic view of a lifting assembly 100, in use with a lift mechanism 10 installed in a vehicle 12, in accordance with one or more embodiments of the present invention.

Referring now to the drawings, FIG. 1 illustrates a diagrammatic view of a lifting assembly (referred by the numeral 100) in use with a lift mechanism 10 installed in a vehicle 12. The lifting assembly 100 makes lifting and storing a travelling aid, like a wheelchair, a scooter or a power-chair inside your vehicle virtually effortless. The lifting assembly 100 of the present disclosure allows a user to lift any wheelchair, whether new or old, without any particular modification to the wheelchair. Although, the present embodiments have been described in terms of the lifting assembly 100 being implemented for lifting and hoisting of a wheelchair to be stored in a vehicle, such as for travel purposes or the like; however, it may be contemplated by a person skilled in the art that the present lifting assembly 100 can alternatively be implemented for various other purposes, including, but not limited to, as a crane for transference of goods and items, or the like.

The utilized lift mechanism 10, cooperating with the lifting assembly 100 of the present disclosure, may be a conventional lift mechanism which may be installed in a trunk of the vehicle 12. Such lift mechanism 10 may include a base plate fixedly attached to the vehicle, a vertical support post made of a plurality of sections and supported on the base plate, and an arm assembly, generally horizontally arranged, and attached to the vertical post section. The base plate may be adapted for mounting on a base of the trunk of the vehicle. The arm assembly may be extending outward from the vertical support post for attachment to the wheelchair or the like. The base plate is designed and arranged to facilitate side movement of the vertical support post after the wheelchair has been lifted, in order to allow for hoisting of the suspended wheelchair from the ground to the trunk of the vehicle and vice-versa, as required by the user. It may be understood that the vehicle 12 being employed may be any suitable vehicle, preferably a pickup truck or a vehicle with large trunk or boot space for easy installation of the lift mechanism 10 and further storage of the wheelchair therein.

Figure 2:
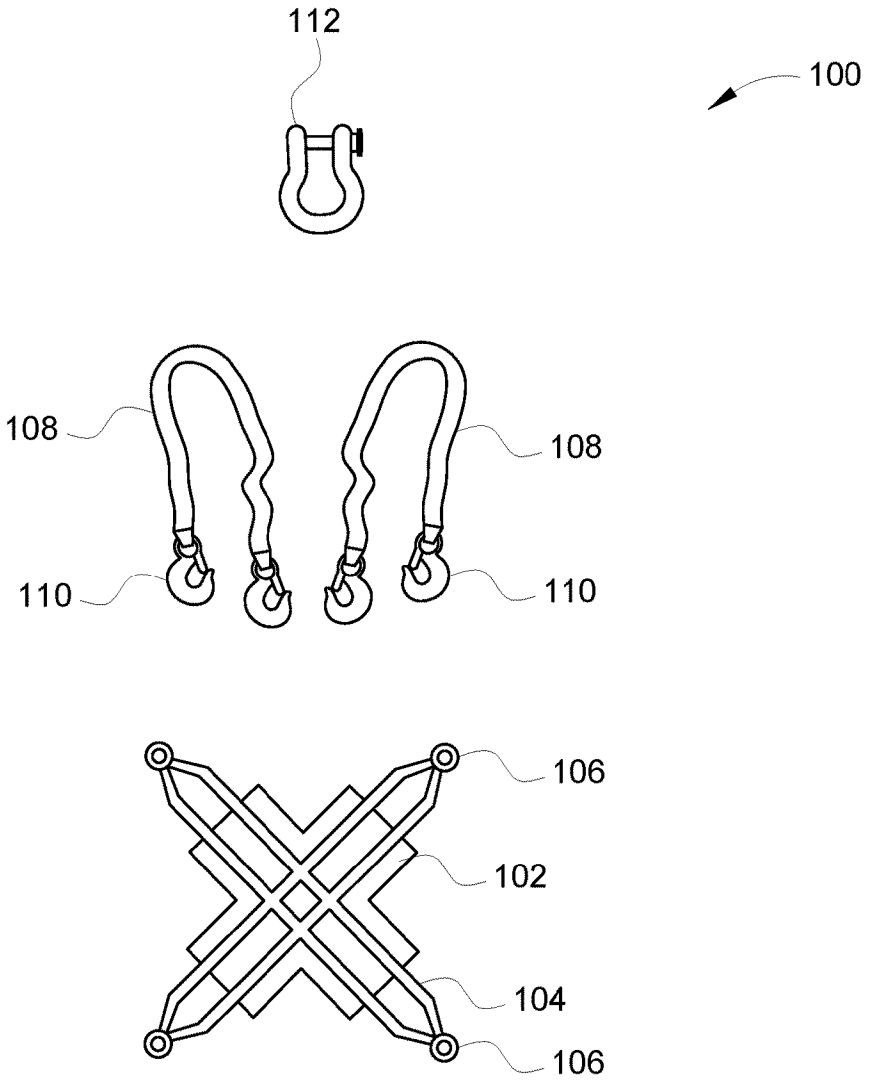
FIG. 2 illustrates an exploded diagrammatic view of the lifting assembly 100, in accordance with one or more embodiments of the present invention.

FIG. 2 illustrates an exploded diagrammatic view of the lifting assembly 100. In particular, FIG. 2 shows individual components of the lifting assembly 100 for better understanding of the arrangement and functioning thereof. As illustrated, the lifting assembly 100 includes a supporting structure 102 which is designed in the shape of a cross member. For example, the supporting structure 102 may be a cloth structure made of two intersecting pieces of strips of cloth crossing each other. The supporting structure 102 may be made of a strong and flexible material, like reinforced cotton fibers (like steel-cotton fabric) or plastics (like polyethylene or polypropylene) or even metallic sheets (like sheets made of aluminum). It may be understood that the two strips of the supporting structure 102 may be joined together by any suitable means. For instance, the strips being pieces of cloth could be stitched together. In other example, the strips being plastic or metallic pieces could be welded together.

Further, as illustrated, the lifting assembly 100 includes a connecting arrangement 104 attached to the supporting structure 102. In one example, the connecting arrangement 104 may also be in the form of a cross member extending with shape of the supporting structure 102. The connecting arrangement 104 may be made of a strong material, such as stainless steel, aluminum and the like. Further, the connecting arrangement 104 may be attached to the supporting structure 102 using any suitable method, such as, welding, use of fastening members, adhesives, etc. without any limitations. As may be seen from FIG. 2, the connecting arrangement 104 may include apertures 106 formed at each of its four ends to allow for engagement of some other member therewith (as discussed in the subsequent paragraphs).

As illustrated in FIGS. 1 and 2, the lifting assembly 100 includes two or more cables 108 which are coupled from one of their ends with the connecting arrangement 104. Specifically, the cables 108 may include quick-release snap hooks 110 fixed thereto at their said ends. These snap hooks 110 may engage with the opposing apertures 106 of the connecting arrangement 104 to be removably coupled therewith. Such use of snap hooks for engagement may be easily contemplated and have not been described in further detail herein. Therefore, the cables 108 may be used to suspend the supporting structure 102. It may be understood that the supporting structure 102, when in suspended form, may provide shape of a sling arrangement which can be used to support a suitable item therein.

Further, in accordance with present embodiments, the lifting assembly 100 includes at least one shackle 112 which is adapted to be fixedly attached with the lift mechanism 10. It may be contemplated that the shackle 112 may be attached with the lift mechanism 10 by means of screws or some other suitable fastening means known in the art. Moreover, the shackle 112 may be coupled with the cables 108 at their other ends (opposite to the ones coupled with the connecting arrangement 104). Thus, the shackle 112 may mechanically couple, and helps to bear and transfer weight of the supporting structure 102, to the lift mechanism 10. In one example, the shackle 112 may be designed and reinforced for supporting weights up to 8-10 tons, as may be required for the purpose of lifting a wheelchair or the like of the present disclosure. Such shackles are well known in the art and widely available in the markets for use.

Figure 3:
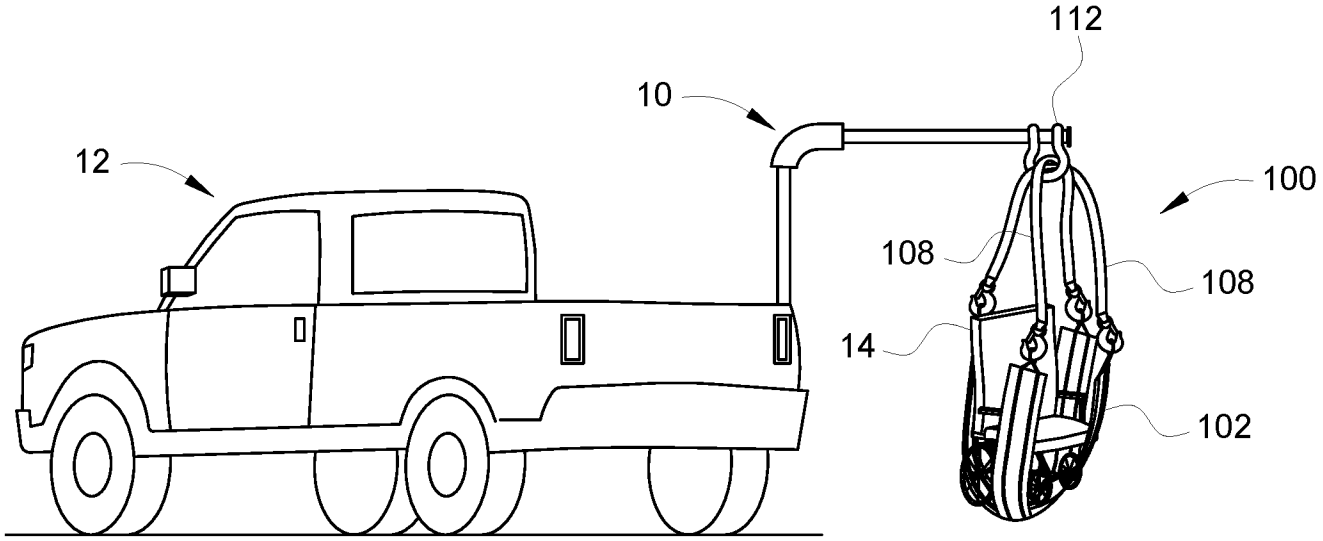
FIG. 3 illustrates a diagrammatic view of the lifting assembly 100 being implemented to lift a wheelchair 14 in cooperation with the lift mechanism 10, in accordance with one or more embodiments of the present invention.

With reference to FIGS. 1 and 2, in combination, it may be contemplated that the supporting structure 102 of the lifting assembly 100 may be able to support a desired item therein, and further allow to hoist the supported item by means of the lift mechanism 10, as may be desired by the user. The supporting structure 102 being a cross-member form a sling arrangement during suspension thereof by cables 108, and thus may be able to wrap around most of the common items, including a wheelchair with ease. Thus, the lifting assembly 100 could easily be able to provide lift support and transfer the wheelchair from one location to another utilizing the power of the lift mechanism 10. FIG. 3 depicts the lifting assembly 100 of the present disclosure being implemented for lifting a wheelchair 14. It may be understood that the wheelchair 14 may be lifted from the ground and hoisted to be stowed in the trunk of the vehicle 12 at the beginning of a journey; and subsequently may be removed from the trunk, hoisted and placed back on the ground for use by the user.

As discussed, the lifting assembly 100 of the present disclosure allows a user to lift any wheelchair, whether new or old, without any particular modification to the wheelchair. This eliminates the need of making modification to the wheelchair and the like, thus saving the user the extra expense otherwise spent on hiring a technician and material costs for making such modifications. It shall be noted that the structural modifications made to the vehicle for installing the lift mechanism can be easily removed for vehicle resale purposes or the like. The lifting assembly 100 of the present disclosure is light-weight, compact and portable making it convenient for the user to handle, and thus also can be easily stowed away in the vehicle when not in use. Furthermore, the lifting assembly 100, being compact, can be shipped directly to the customer via some courier or home delivery services. The lifting assembly 100 of the present disclosure may particularly be useful for handicapped people, old-age persons, injured patients and the like; and may particularly find its applications in, but not limited to, hospitals, old-age homes, families with one or more senior members, and the like.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A lifting assembly to be used with a lift mechanism, the lifting assembly comprising:

a supporting structure in the shape of a cross member;

a connecting arrangement attached to the supporting structure;

a shackle adapted to be fixedly attached with the lift mechanism; and two or more cables coupled at four ends of the connecting arrangement, wherein said two or more cables are inserted within said shackle, wherein the connecting arrangement is in the form of a cross member similar to the supporting structure, wherein the connecting arrangement includes apertures formed at each of said four ends thereof, wherein said two or more cables comprise hooks fixed thereto at their ends, wherein the hooks of each cable engage with the opposing apertures of the connecting arrangement to be removably coupled therewith, wherein said hooks are quick-release snap hooks.

2. The lifting assembly of claim 1, wherein the supporting structure comprises two intersecting pieces of strips crossing each other.

3. The lifting assembly of claim 2, wherein the pieces of strips are made of one of steel-cotton fabric, plastics and sheets of aluminum.

4. The lifting assembly of claim 1, wherein the connecting arrangement is made of one of stainless steel and aluminum.

5. The lifting assembly of claim 1, wherein the connecting arrangement is attached to the supporting structure using one of welding, fastening members and adhesives.

6. The lifting assembly of claim 1, wherein the shackle is attached with the lift mechanism using one or more screws.

* * * * *